United States Patent [19]

Reuter et al.

[11] Patent Number: 5,069,269

[45] Date of Patent: Dec. 3, 1991

[54] LIFTING AND TURNING UNIT FOR A MELTING AND/OR CASTING PLANT

[75] Inventors: Wolfgang Reuter, Niddatal; Josef Gediga, Bruchkoebel, both of Fed. Rep. of Germany

[73] Assignee: Leybold Aktiengesellschaft, Fed. Rep. of Germany

[21] Appl. No.: 609,012

[22] Filed: Oct. 30, 1990

Related U.S. Application Data

[63] Continuation of Ser. No. 377,134, Jul. 10, 1989, abandoned.

[30] Foreign Application Priority Data

Jan. 23, 1989 [DE] Fed. Rep. of Germany ..... 3901824

[51] Int. Cl.[5] ..... B22D 5/02; B22D 18/06

[52] U.S. Cl. ..... 164/325; 164/253; 164/412; 414/217; 414/672; 269/61; 269/71

[58] Field of Search ..... 164/253, 512, 513, 514, 164/322, 323, 324, 325, 326, 412; 414/217, 662, 672; 269/61, 71

[56] References Cited

U.S. PATENT DOCUMENTS

| | | | |
|---|---|---|---|
| 2,557,149 | 8/1951 | Sedgwick | 164/326 |
| 4,538,068 | 8/1985 | Haney et al. | 414/217 |
| 4,750,541 | 6/1988 | Reuter et al. | 164/412 |
| 4,781,511 | 11/1988 | Harada et al. | 414/217 |

FOREIGN PATENT DOCUMENTS

| | | |
|---|---|---|
| 1186984 | 2/1965 | Fed. Rep. of Germany . |
| 3608587A1 | 9/1987 | Fed. Rep. of Germany . |
| 3626745C1 | 9/1987 | Fed. Rep. of Germany . |
| 3709354A1 | 9/1988 | Fed. Rep. of Germany . |
| 246523 | 6/1987 | German Democratic Rep. . |
| 912608 | 12/1962 | United Kingdom . |

OTHER PUBLICATIONS

Vorrichtung zum mechanisohen Auf-und Absetzen, Wenden sowie Zulegen von Formkasten, dated 2/18/53; pp. 1-9.

*Primary Examiner*—Richard K. Seidel
*Assistant Examiner*—Rex E. Pelto
*Attorney, Agent, or Firm*—Hill, Van Santen, Steadman & Simpson

[57] ABSTRACT

A lifting and turning unit for a melting or casting plant. The lifting and turning unit for a deposit stand, preferably a table, for ingot molds of a vacuum melting and casting plant is provided. The unit consists of a tubular, vertically arranged lifter column that is axially movable with a hydraulic piston-cylinder unit and that has its upper end carrying the ingot mold table. A guide system composed of guide columns and of a yoke is provided. The guide columns serve for guiding the lifter column and for protecting the lifter column against twisting. The drive for the rotation of the rotatable ingot mold table is connected to the lifter column away from the harsh chamber environment. The unit provides an extremely low maintenance lifting and turing device wherein the longitudinal movements and the rotary movements can be executed separately from one another and thus allow for an exact positioning of the table.

23 Claims, 2 Drawing Sheets

LIFTING AND TURNING UNIT FOR A MELTING AND/OR CASTING PLANT

This is a continuation of application Ser. No. 377,134, filed Jul. 10, 1989, now abandoned.

BACKGROUND OF THE INVENTION

The present invention is directed to a lifting and turning unit for a deposit stand, preferably a table or platform, for one or more ingot molds of a melting and/or casting plant that, in particular, operates under vacuum or under a protective gas atmosphere.

Melting and casting plants are utilized in vacuum processing technology for research and development and for production. The critical component parts of these systems are a vacuum chamber, a pump stand and an energy supply system with control unit. The operation of such systems occur under high-vacuum, under a protective gas atmosphere or a normal atmosphere.

Lifting and turning tables for ingot molds are utilized in these plants in many instances. Such an ingot mold lifting mechanism is described, for example, in a brochure of the former Leybold-Heraeus GmbH & Co. KG, No. M 2.110 d having the title "Fertigen hochreiner und extrem belastbarer Bauelemente".

SUMMARY OF THE INVENTION

The present invention provides the following objects:

Prerequisites for an exact positioning of the ingot mold table are determined. The lifting and turning unit for the ingot mold table is easy to maintain. Complete independence between the lifting movements of the table and the turning movements are possible. The conditions are created that, for maintenance purposes, the table can be dismantled without dismantling the lifting mechanism. In the same fashion, the lifting column itself is capable of being dismantled or removed in an upward direction, i.e. within the vacuum chamber, without dismantling other parts of the lifting mechanism.

A universal employment of the lifting and turning unit is possible with the present invention. In particular, an easy adaptation to customer-requirements is capable of being carried out. An increase in flexibility when operating the plant is possible with the lifting and turning unit of the present invention to obtain a high operating reliability.

The stated objects are inventively achieved in that a stationary guide means is provided on which a movable lifting mechanism for the deposit stand is supported and that guides the lifting mechanism; and in that the lifting mechanism is the bearing element for a turning mechanism for the deposit stand.

It can thereby be provided that the lifting mechanism consists of a tubular, vertically arranged lifting column that is axially movable with a hydraulic piston-cylinder unit that has its upper end projecting into the region of a vacuum chamber and carries parts of the turning mechanism therein.

For sealing the vacuum chamber with respect to the unit, it is proposed that the lifting column is sealed and seated in a vacuum pressure stage member in the region of the vacuum chamber, and that an element that assumes the plain bearing function and sealing function is preferably provided.

An especially compact structure is achieved in that the lifter column surrounds the hydraulic piston-cylinder unit.

According to a preferred embodiment, the lifter column and the piston-cylinder unit it surrounds is the bearing element for the parts of the drive of the rotatable ingot mold table.

In accordance with this principle, it is proposed that the lifter column carries parts of the drive for the turning mechanism at its lower end via a foot part and carries the bearing for the rotatable deposit stand at its upper end, preferably by means of a head flange.

A further development of this principle is that the drive for the turning mechanism consists of a drive shaft that is arranged inside the tubular lifter column, in that the drive shaft has its upper region seated in a head part of the hydraulic piston-cylinder unit and has its lower region seated in the foot part of the lifter column.

It is also provided in accordance with the structure that has been set forth that the tubular lifter column has its upper region encompassing a gearing unit for the rotatable support, preferably for the rotatable table.

A stationary guide means is included in the unit. More specifically, this guide means is composed of at least one guide column that serves for the guidance of the lifter column and to prevent twisting thereof and of a yoke that connects the piston rod of the hydraulic piston-cylinder unit to the guide column.

A second exemplary embodiment is distinguished by an extremely compact structure. It is provided that a unit composed of an electromotive drive and of a gearing for the rotatable support is arranged within the lifter column in the upper region thereof.

For protecting the vacuum pressure stage member and the parts of the unit arranged in the region thereof, a bellows-shaped protective part, particularly a fireproof textile hose, is arranged between the upper end of the lifter column, particularly a head flange of the lifter column, and the wall of the vacuum container.

It has proven expedient that the drive motor for the rotatable deposit stand together with the drive mechanism for the drive shaft are secured to the lower end of the lifter column.

In a further development of the present invention, an eye-shaped component part fashioned as an anti-twist element and guide element is secured to the lower end of the lifter column, this eye-shaped component part being guided at the guide column in a sliding manner.

The following advantages are obtained with the present invention:

In addition to achieving the stated objects, prerequisites for a exact positioning of the ingot mold table and, thus, of the ingot molds themselves are provided by the present invention. In particular, an exact separation of the lifting motions of the table from the turning motions thereof is achieved. For maintenance purposes, the turntable can be disassembled without dismantling the lifting mechanism.

A centrifuging of the molten metal in the ingot mold can be carried out with the turntable of the present invention. With, for example, an ingot mold rotating on the turntable, the molten metal can be treated by centrifuging in this manner such that bubbles are eliminated.

Further details of the present invention may be derived from the following description of two exemplary embodiments of the present invention.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures in which like reference numerals identify like elements, and in which:

DESCRIPTION OF THE PREFERRED EMBODIMENT

Figure 1:
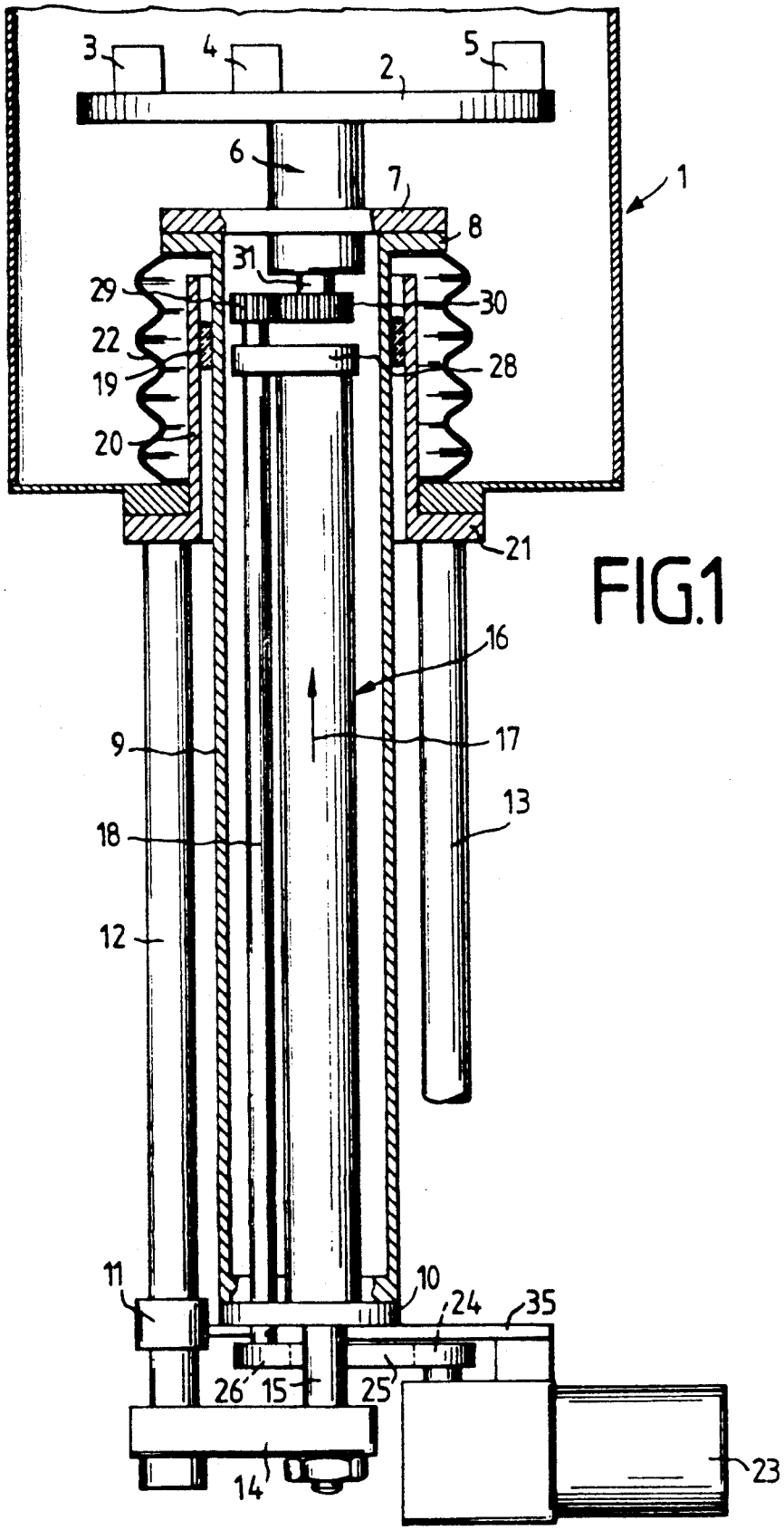
FIG. 1 shows a first exemplary embodiment of a lifting and turning means for an ingot mold table in a schematic view, partially cut.

The present invention has general applicability, but is most advantageously utilized in a system as shown in FIG. 1. FIG. 1 depicts a vacuum chamber 1 in which a turntable 2 is located. Ingot molds 3, 4, 5 are situated on the turntable 2.

The bearing or support for the rotating turntable 2 is referenced 6 and it is secured to a flange 7. This bottom flange 7 of the turntable 2 is connected to a head flange 8 of a lifter column 9. At its lower end, the lifter column 9 is provided with a foot part 10.

On one hand, the lifter column 9 is guided along the guide column 12 in an axial direction with an eye-shaped component part 11; on the other hand, the component part 11 prevents the lifter column from twisting relative to a guide system whereof the guide column 12 represents one part.

In FIG. 1, this guide system is composed of the two guide columns 12, 13 and a yoke 14. Reference numeral 15 references the lower end of a piston rod of a hydraulic piston-cylinder unit. The system composed of the guide column 12, yoke 14 and the lower end 15 of the piston rod can be referred to as being stationary relative to the lifter column 9.

Reference numeral 16 references the cylinder of the hydraulic piston-cylinder unit. When this unit is charged with hydraulic fluid, the cylinder 16 moves upward in the direction of the arrow 17, whereas the lower end 15 of the piston rod is retained by the yoke 14. The cylinder 16 is rigidly connected to the lifter column 9 via a foot part 10. The lifter column 9 thus also executes the upward motion.

In its upper region, the lifter column 9 is sealed relative to the vacuum pressure stage member 20 by a seal element 19. This seal element 19 also serves the function of a plain bearing. For upward movement of the cylinder and of the lifter column, the head flange 8, the bottom flange 7, the bearing 19 for the turntable 2 as well as the turntable 2 itself are lifted.

A flange 21 is attached to the lower end of the vacuum pressure stage member 20. The guide columns 12 and 13 are secured to this flange 21.

A fire-proof textile hose 22 fashioned as an axially compressible bellows is provided in order to protect the upper end of the lifter column 9 and other parts in the region of the upper end of the lifter column 9 in order to protect the vacuum pressure stage member 20 against spattering.

A motor 23 is provided and a V-belt pulley 24 drives a V-belt pulley 26 of a drive shaft 18 via a V-belt 25. The motor 23 and the V-belt drive are connected to the lower end of the lifter column 9 by a fastening element 35. The eye-shaped component part 11 is likewise connected to the lower end of the lifter column 9. The motor 23, V-belt drive and component part 11 thus move up or down together with the lifter column 9.

The drive shaft 18 is seated in the foot part 10 of the lifter column 9. The upper bearing of the drive shaft 18 is attached to a head part 28 of the hydraulic piston-cylinder unit. A gear wheel 29 meshes with a gear wheel 30. The drive shaft 31 for the turntable 2 and the turntable 2 itself are placed in rotational motion in this manner.

As may be seen from the exemplary embodiment of FIG. 1, the longitudinal movements, i.e. the axially upward or downward movements of the turntable 2, can be executed independently of the rotary movements of the table 2. An exact positioning of the table 2 is thus possible.

Figure 2:
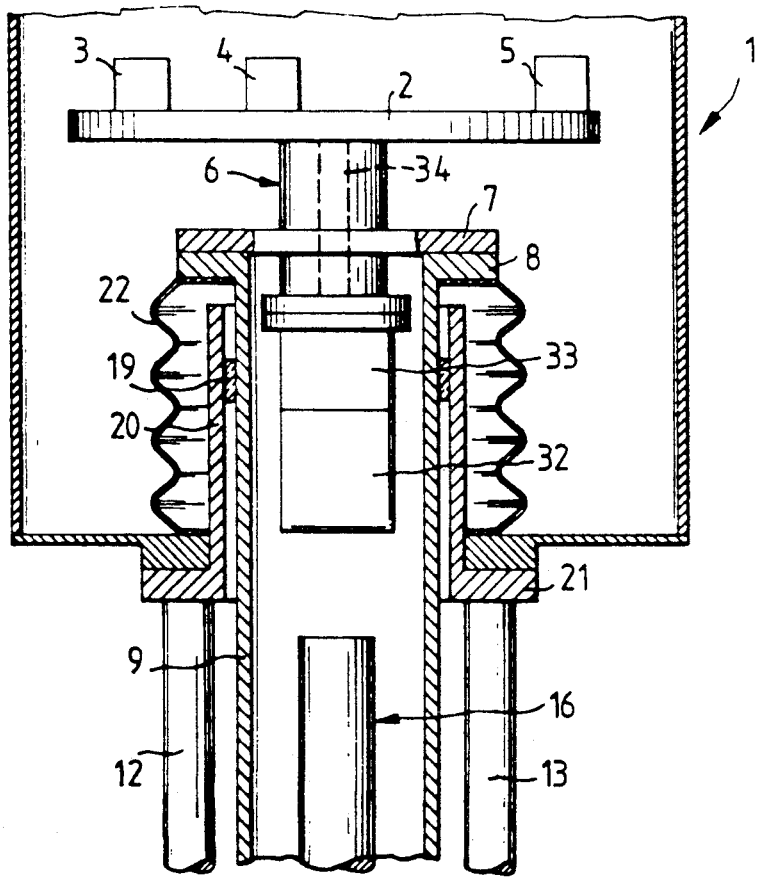
FIG. 2 shows a second exemplary embodiment of the present invention.

The exemplary embodiment of FIG. 2 provides a unit composed of an electric motor 32 and of gearing 33. This unit is accommodated in the region of the upper end of the lifter column 9 and is directly connected to the drive shaft 34 for the turntable 2. The drive shaft 34 is shown in broken lines. The individual parts in FIG. 2 that are the same as in FIG. 1 bear the same reference numerals as in FIG. 1.

In the exemplary embodiment of FIG. 2, the table 2 is placed in rotary movement with the described unit. The lifting motions of the table 2 are caused by the lifter column 9.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. In at least one of a melting system, a casting system or a melting and casting system of a plant operating, in particular, under vacuum or in a protective gas atmosphere, a lifting and turning unit for a deposit stand for supporting one or more ingot molds in said operation of said plant, comprising a means for providing a stationary guide mechanism supporting a movable lifter mechanism for the deposit stand, the means for providing a stationary guide also guiding the lifter mechanism, the lifter mechanism having an upper end and being a support element for a rotary mechanism attached to the deposit stand, the lifter mechanism upper end being in a chamber having the vacuum or protective gas atmosphere to impart lifting and turning motion to the deposit stand while in the chamber, the lifter mechanism carrying parts of the drive for the rotary mechanism below the upper end and outside of the chamber, the lifter mechanism being a tubular, vertically arranged lifter column that is axially moveable with a hydraulic piston-cylinder unit, the lifter column surrounding the hydraulic piston-cylinder unit and the lifter column and the piston-cylinder unit it surrounds forming the support element for the parts of the drive of the rotary mechanism, the lifter column carrying the parts of the drive of the rotary mechanism via a foot part at its lower end.

2. The lifting and turning unit according to claim 1, wherein the lifter column is sealed and seated in a vacuum pressure stage member in the region of the vacuum chamber; the lifter column being sealed by an element that functions as a plain bearing and a seal.

3. The lifting and turning unit according to claim 1, wherein a bellows-shaped protective part is located between the upper end of the lifter column and a wall of the vacuum chamber.

4. The lifting and turning unit according to claim 3, wherein the bellows-shaped protective part is a fireproof textile hose.

5. The lifting and turning unit according to claim 3, wherein the upper end of the lifter column is connected to a head flange which provides support for the rotation of the deposit stand.

6. The lifting and turning unit according to claim 1, wherein the means for providing a guide mechanism is composed of at least one guide column for guiding the lifter column and for preventing the lifter column from substantially twisting and of a yoke that connects a piston rod of the hydraulic piston-cylinder unit to the guide column.

7. The lifting and turning unit according to claim 6, wherein the unit further comprises a component part serving as an anti-twist element and as a guide element, and fashioned eye-shaped, is secured to the lower end of the lifter column, said component part being guided at the guide column in a sliding fashion.

8. The lifting and turning unit according to claim 1, wherein a unit composed of an electromotive drive connected to a gearing unit for rotation of the deposit stand is located inside the lifter column in an upper region thereof.

9. The lifting and turning unit according to claim 1, wherein the lifter column, which has a tubular configuration, has an upper region containing a gearing unit of the rotary mechanism for rotation of the deposit stand, the gear unit being one of the parts of the drive of the rotary mechanism.

10. A lifting and turning unit for a deposit stand for supporting one or more ingot molds and for use in at least one of a melting system, a casting system or a melting and casting system of a plant operating, in particular, under vacuum or in a protective gas atmosphere, comprising a means for providing a stationary guide mechanism supporting a movable lifter mechanism for the deposit stand, the means for providing a stationary guide also guiding the lifter mechanism, the lifter mechanism being a support element for a rotary mechanism attached to the deposit stand, the lifter mechanism being a tubular, vertically arranged lifter column that is axially movable with a hydraulic piston-cylinder unit that has its upper end projecting into a region of a vacuum chamber and that carries at least parts of the rotary mechanism therein, the lifter column surrounding the hydraulic piston-cylinder unit and the lifter column and the piston-cylinder unit it surrounds forming the support element for parts of a drive of the rotary mechanism for the deposit stand for the ingot molds, the lifter column carrying the parts of the drive for the rotary mechanism via a foot part at its lower end and carrying a support for rotation of the deposit stand at its upper end.

11. The lifting and turning unit according to claim 10, wherein the rotary mechanism consists of a drive shaft that is located inside the lifter column which has a tubular configuration, the drive shaft having an upper region seated in a head part of the hydraulic piston-cylinder unit and having a lower region seated in the foot part of the lifter column.

12. The lifting and turning unit according to claim 11, wherein a drive motor for rotation of the deposit stand is connected to a drive mechanism which is connected to the drive shaft, the drive motor and drive mechanism being both connected to the lower end of the lifter column.

13. The lifting and turning unit according to claim 10, wherein said support for the rotation of the deposit stand is a head flange.

14. In at least one of a melting system, a casting system or a melting and casting system in a plant, the plant having a predetermined atmosphere in a chamber containing at least the deposit stand, a lifting and turning unit for a deposit stand for supporting at least one ingot mold, comprising:

a stationary guide mechanism supporting a movable lifter mechanism rotatably connected to the deposit stand;

the movable lifter mechanism having a hydraulic piston-cylinder with a piston rod and having a tubular, vertically oriented lifter column movable in a vertical axial direction by the hydraulic piston-cylinder, the lifter column surrounding the hydraulic piston-cylinder and having an upper end projecting into a region of the chamber;

the guide mechanism having at least one guide column having a first upper end attached to the chamber and a lower region slidable engaging an eye-shaped portion of a component part, the component part being attached to a lower end of the lifter column, the guide mechanism also having a yoke connecting a second lower end of the guide column to a lower end of the piston rod of the hydraulic piston-cylinder; and a rotary mechanism connected to the deposit stand and supported by the movable lifter mechanism, the rotary mechanism having parts of a drive for rotating the deposit stand, the lifter column carrying the parts of the drive for the rotary mechanism below the upper end and outside of the chamber via a foot part at a lower end of the lifter column and the lifter column carrying a support for rotation of the deposit stand at an upper end of the lifter column.

15. The lifting and turning unit according to claim 14, wherein the lifter column, which has a tubular configuration, has its upper end containing a gearing unit of the rotary mechanism for rotation of the deposit stand, the gear unit being one of the parts of the drive of the rotary mechanism.

16. The lifting and turning unit according to claim 15, wherein the bellows-shaped protective part is a fireproof textile hose.

17. The lifting and turning unit according to claim 15, wherein the upper end of the lifter column is connected to a head flange which provides support for the rotation of the deposit stand.

18. The lifting and turning unit according to claim 14, wherein a unit composed of an electromotive drive connected to a gearing unit for rotation of the deposit stand is located inside the lifter column in the upper end thereof.

19. The lifting and turning unit according to claim 14, wherein a bellows-shaped protective part is located between the upper end of the lifter column and a wall of the vacuum chamber.

20. A lifting and turning unit for a deposit stand for supporting at least one ingot mold and for use in at least one of a melting system, a casting system or a melting and casting system in a plant, the plant having a predetermined atmosphere in a chamber containing at least the deposit stand, comprising:

a stationary guide mechanism supporting a movable lifter mechanism rotatably connected to the deposit stand;

the movable lifter mechanism having a hydraulic piston-cylinder with a piston rod and having a tubular, vertically oriented lifter column movable in a vertical axial direction by the hydraulic piston-cylinder, the lifter column surrounding the hydraulic piston-cylinder and having an upper end projecting into a region of the chamber;

the guide mechanism having at least one guide column having a first upper end attached to the chamber and a lower region slidable engaging an eye-shaped portion of a component part, the component part being attached to a lower end of the lifter column, the guide mechanism also having a yoke connecting a second lower end of the guide column to a lower end of the piston rod of the hydraulic piston-cylinder; and a rotary mechanism connected to the deposit stand and supported by the movable lifter mechanism, the rotary mechanism having parts of a drive for rotating the deposit stand, the lifter column carrying the parts of the drive for the rotary mechanism via a foot part at its lower end and carrying a support for rotation of the deposit stand at its upper end.

21. The lifting and turning unit according to claim 20, wherein said support for the rotation of the deposit stand is a head flange.

22. The lifting and turning unit according to claim 20, wherein the rotary mechanism consists of a drive shaft that is located inside the lifter column which has a tubular configuration, the drive shaft having an upper region seated in a head part of the hydraulic piston-cylinder unit and having a lower region seated in the foot part of the lifter column.

23. The lifting and turning unit according to claim 22, wherein a drive motor for rotation of the deposit stand is connected to a drive mechanism which is connected to the lower region of the drive shaft, the drive motor and drive mechanism being both connected to the lower end of the lifter column.

* * * * *